United States Patent [19]

Asakura et al.

[11] Patent Number: 4,694,803

[45] Date of Patent: Sep. 22, 1987

[54] AIR-FUEL RATIO CONTROL SYSTEM FOR AN INTERNAL COMBUSTION ENGINE WITH AN ATMOSPHERIC PRESSURE RESPONSIVE CORRECTION OPERATION

[75] Inventors: Masahiko Asakura, Tokorozawa; Tomohiko Kawanabe, Utsunomiya; Masahiro Ueda, Asaka; Shinichi Kubota, Nagareyama; Noritaka Kushida, Tokyo; Yukihiro Matsumoto, Fujimi, all of Japan

[73] Assignee: Honda Giken Kogyo Kabushiki Kaisha, Tokyo, Japan

[21] Appl. No.: 819,454

[22] Filed: Mar. 10, 1986

[30] Foreign Application Priority Data

Apr. 16, 1985 [JP] Japan ..... 60-081178
Apr. 16, 1985 [JP] Japan ..... 60-081179

[51] Int. Cl.[4] ..... F02B 3/00

[52] U.S. Cl. ..... 123/440; 123/489; 123/494

[58] Field of Search ..... 123/489, 440, 465, 494

[56] References Cited

U.S. PATENT DOCUMENTS 4,393,842 7/1983 Otsuka ..... 123/465
4,413,601 11/1983 Matsuoka ..... 123/465

*Primary Examiner*—Ronald B. Cox
*Attorney, Agent, or Firm*—Pollock, Vande Sande and Priddy

[57] ABSTRACT

An air-fuel ratio control system for an internal combustion engine, including an oxygen concentration sensor producing an output signal whose level is substantially proportional to an oxygen concentration of the exhaust gas, effects a feedback control of the air-fuel ratio of mixture to be supplied to the engine toward a target value determined on the basis of various parameters of the engine operation and corrected in response to a magnitude of atmospheric pressure, so that the target air-fuel ratio is made lean as the magnitude of the atmospheric pressure decreases. Thus, the reduction of the engine output power and the increase of the fuel consumption which have been encountered in conventional systems are prevented.

5 Claims, 11 Drawing Figures

AIR-FUEL RATIO CONTROL SYSTEM FOR AN INTERNAL COMBUSTION ENGINE WITH AN ATMOSPHERIC PRESSURE RESPONSIVE CORRECTION OPERATION

BACKGROUND OF THE INVENTION

1. Field of the Invention

The present invention relates to an air-fuel ratio control system for an internal combustion engine of a vehicle, and more particularly relates to a system in which the air-fuel ratio of the mixture to be supplied to the vehicle engine is controlled toward a target value in response to an output signal level of an oxygen concentration sensor.

2. Description of Background Information

Air-fuel ratio feedback control systems for a vehicle internal combustion engine are known wherein the oxygen concentration in the exhaust gas of the engine is detected by an oxygen concentration sensor (referred to an $O_2$ sensor hereinafter) and an air-fuel ratio of mixture to be supplied to the engine is feedback controlled in response to an output signal level of the $O_2$ sensor for the purification of the exhaust gas and improvements of the fuel economy. As an example of such an air-fuel ratio feedback control system, an air-intake side secondary air supply system for the feedback control is proposed, for example, in Japanese Patent Publication No. 55-3533 in which an open/close valve is disposed in an air intake side secondary air supply passage leading to a carburetor of the engine and a duty ratio of the open and close of the open/close valve, i.e. the supply of the air intake side secondary air, is feedback controlled in response to the output signal level of the $O_2$ sensor.

In the usual air-fuel ratio feedback control systems, it is customary to use an $O_2$ sensor whose output signal level is not proportional to the oxygen concentration in the exhaust gas. On the other hand, an $O_2$ sensor whose output signal level varies generally in proportion to the oxygen concentration in the exhaust gas when the air-fuel ratio of the mixture to be supplied to the engine is leaner than a stoichiometric air-fuel ratio has been developed recently. For instance, an air-fuel ratio control system using an $O_2$ sensor of the above mentioned type for precisely controlling the air-fuel ratio toward a target air-fuel ratio in a lean air-fuel ratio is described in Japanese patant application laid open No. 58-59330.

In the air-fuel ratio feedback control system in which the air-fuel ratio is controlled by a feedback operation toward a target air-fuel ratio using such a "lean $O_2$ sensor", the target air-fuel ratio is usually determined from a pressure within the intake pipe on the down stream side of the throttle valve, and the engine speed. However, even with this type of air-fuel ratio feedback control system, the air-fuel ratio of the mixture tends to become rich when the vehicle is running in an area of high altitude. This is because the density of the intake air of the engine becomes small in such an area, which means that the weight of the intake air is smaller than that in the normal area. Therefore, those air-fuel ratio control systems have been encountering a problem that the engine output power reduces when the vehicle is running in an area of high altitude.

Further, it is conceivable to control the air-fuel ratio of the mixture, in an area of high altitude, toward a target air-fuel ratio by means of the above described air intake side secondary air supply system. However, in that case, there is a problem of an increase of fuel consumption as a result of a delay of response of the air-fuel ratio control system. Generally, this delay of response is caused primarily by a time period required for detecting a change in the air-fuel ratio of the mixture supplied to the engine by means of the $O_2$ sensor as a change in an oxygen concentration in the exhaust gas, and secondarily by a driving condition of the vehicle which may be varied rapidly.

OBJECTS AND SUMMARY OF THE INVENTION

An object of the present invention is to provide an air-fuel ratio control system for an internal combustion engine of a vehicle, in which the reduction of the vehicle engine output power in an area of high altitude is prevented.

Another object of the present invention is to provide an air-fuel ratio control system for an internal combustion engine of a vehicle which is aimed for an improvement of fuel consumption characteristics in an area of high altitude.

According to the present invention, an air-fuel ratio control system for an internal combustion engine of a vehicle is provided which includes an oxygen concentration sensor producing an output signal having a level generally proportional to the oxygen concentration of the exhaust gas emitted from the engine, means for determining a target air-fuel ratio in accordance with the engine operational parameters while correcting a target air-fuel ratio in accordance with a magnitude of the atmospheric pressure, and means for effecting a feedback control of the air-fuel ratio of the mixture toward the corrected value of the target air-fuel ratio.

According to another aspect of the present invention, an air-fuel ratio control system for an internal combustion engine performs operations of detecting whether an air-fuel ratio of the mixture is leaner or richer with respect to a target air-fuel ratio by means of an output signal level of the $O_2$ sensor that is generally proportional to the oxygen concentration of the exhaust gas, determining a base valve open period of the open/close valve in response to a plurality of engine operational parameters every period or cycle, correcting the base valve open period at least in accordance with a result of the detection of the air-fuel ratio and a level of atmospheric pressure exerted on the vehicle to provide an output valve open period within each period or cycle, and opening the open/close valve during the output valve open period for each period or cycle.

BRIEF DESCRIPTION OF THE DRAWINGS

FIGS. 4 through 6 are flowcharts showing the manner of operation of a CPU 29 in the control circuit 20 in a first embodiment of the air-fuel rato control system according to the present invention, in which FIG. 4 shows a main routine, FIG. 5 shows an A/F routine, and FIG. 6 shows a target air-fuel ratio setting subroutine respectively;

FIGS. 9 through 11 are are flowcharts showing the manner of operation of the CPU 29 in a second embodiment of the air-fuel rato control system according to the present invention, in which FIG. 9 shows the A/F routine, FIG. 10 shows a base valve open period calculation subroutine, and FIG. 11 shows a target air-fuel ratio setting subroutine respecitively.

DETAILED DESCRIPTION OF THE PREFERRED EMBODIMENTS

Referring to FIGS. 1 through 8 of the accompanying drawings, the first embodiment of the air intake side secondary air supply system according to the present invention will be explained hereinafter.

Figure 1:
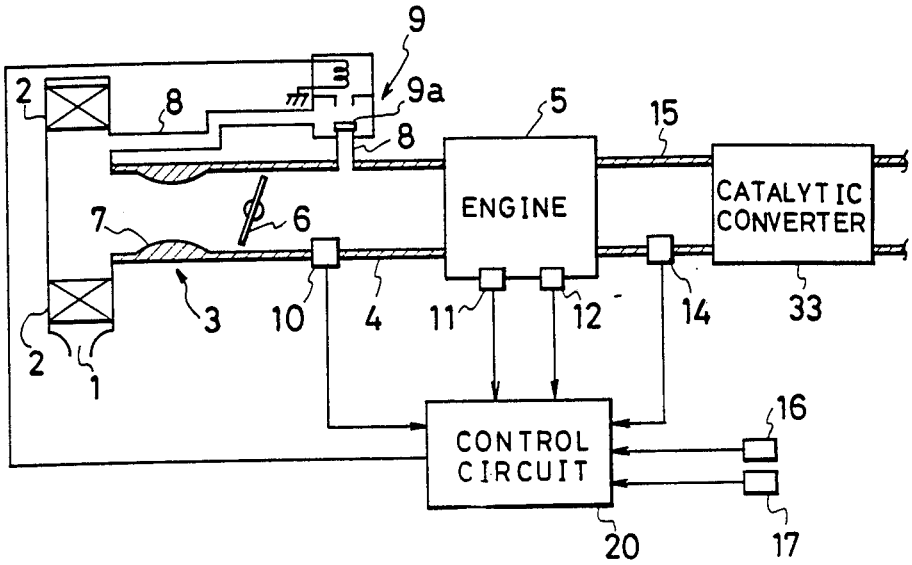
FIG. 1 is a schematic diagram showing a general construction of the system according to the invention.

In FIG. 1 which illustrates a general construction of the air intake side secondary side supply system, intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid 9*a* thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean $O_2$ sensor 14 which is provided in an exhaust manifold 15 of the engine for generating an output signal whose level varies in proportion to the oxygen concentration in the exhaust gas.

Figure 2:
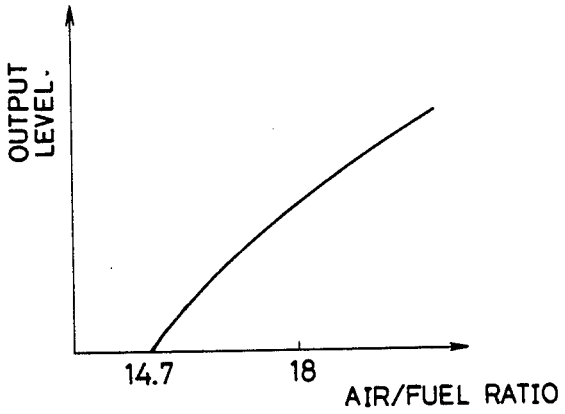
FIG. 2 is a diagram showing a signal output characteristic of the $O_2$ sensor 14 used in the system of FIG. 1.

FIG. 2 shows the signal output characteristic of the $O_2$ sensor 14. As shown, the output signal level of the $O_2$ sensor increases proportionally as the oxygen concentration in the exhaust gas becomes leaner from a stoichiometric air-fuel ratio (14.7). Further, a catalytic converter 33 for accelerating the reduction of the noxious components in the exhaust gas is provided in the exhaust manifold 15 at a location on the downstream side of the position of the $O_2$ sensor 14. The open/close solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 which produces an output signal whose level is proportional to the speed of the vehicle and an atmospheric pressure sensor 17 which produces an outptu signal whose level is responsive to an atmostpheric pressure are electrically connected to the control circuit 20.

Figure 3:
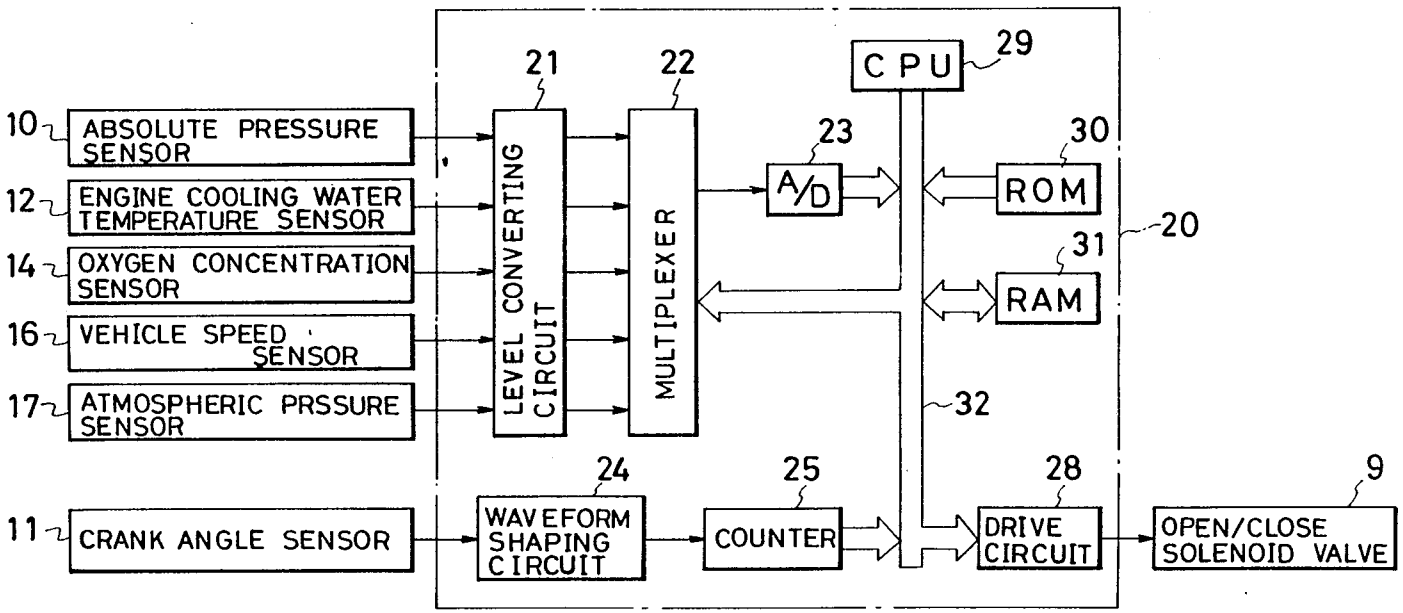
FIG. 3 is a block diagram showing the construction of the control circuit 20 of the system of FIG. 1.

FIG. 3 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, the vehicle speed sensor 16, and the atmospheric pressure sensor 17. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the open/close solenoid valve 9 in an opening direction, a CPU (central processing unit) 29 which performs digital operations according to various programs, and a ROM 30 in which various operating programs and data are previously stored, and a RAM 31. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, is selectively supplied from the A/D converter 23 to the CPU 29 via the input/output bus 32. Also information indicative of the engine speed from the counter 25 is supplied to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter.

Figure 4:
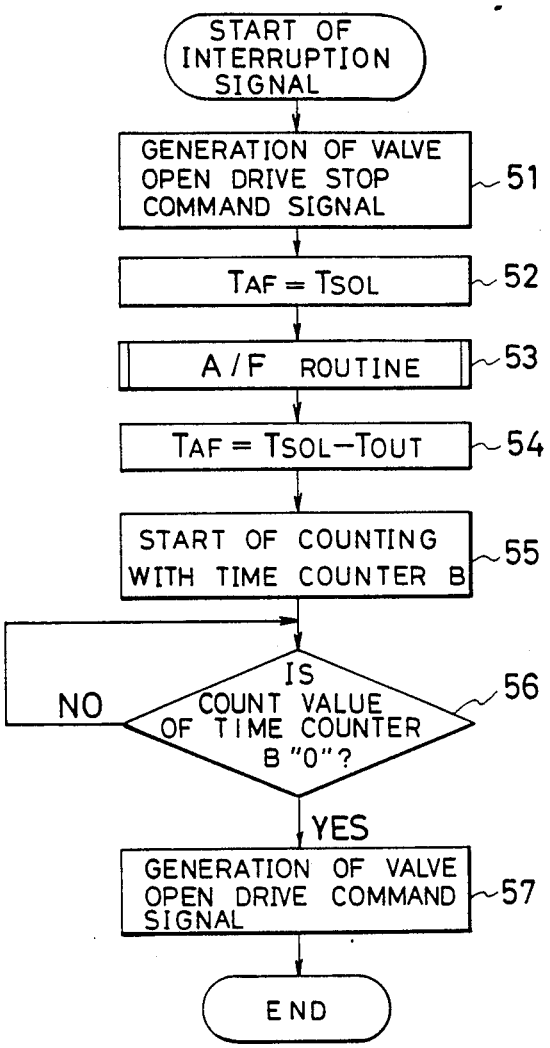
Figure 5:
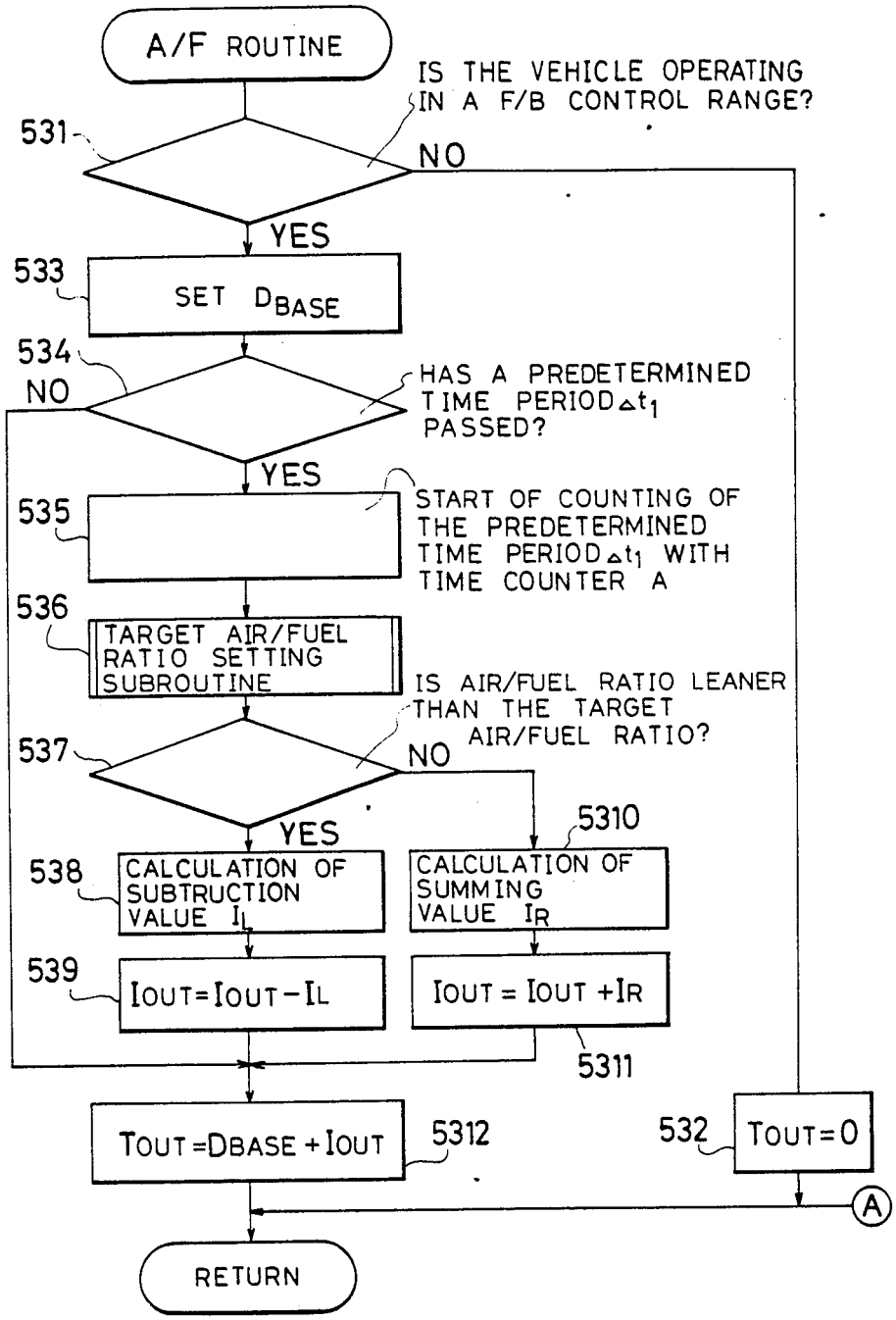

Referring to the flowcharts of FIG. 4 through FIG. 6, the operation of the air-fuel ratio control system according to the present invention will be explained hereinafter.

At a step 51, a valve open drive stop command signal is generated in the CPU 29 and supplied to the drive circuit 28, at every time of the generation of the internal interruption signal in the CPU 29. With this signal, the drive circuit 28 is controlled to close the open/close solenoid valve 9. This operation is provided so as to prevent malfunctions of the open/close solenoid valve 9 during the calculating operation of the CPU 29. Next, a valve close period $T_{AF}$ of the open/close solenoid valve 9 is made equal to a period of one duty cycle $T_{SOL}$ at a step 52, and an A/F routine for calculating a valve open period $T_{OUT}$ of the open/close solenoid valve 9 which is shown in FIG. 5 is carried out through steps generally indicated at 53.

In the A/F routine (FIG. 5), whether or not the operating state of the vehicle (including operating states of the engine) satisfies a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/-close solenoid valve 9, is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 7, and the CPU 29 first reads current values of the absolute pressure $P_{BA}$ and the engine speed $N_e$ and in turn searches a value of the period of base duty ratio $D_{BASE}$ corresponding to the read values from the $D_{BASE}$ date map in the ROM 30. Then, whether or not a count period of a time counter A incorporated in the CPU 29 (not shown) has reached a predetermined time period $\Delta t_1$ is detected at a step 534. This predetermined time period $\Delta t_1$ corresponds to a delay time from a time of the supply of the air intake side secondary air to a time in which a result of the supply of the air intake side secondary air is detected by the $O_2$ sensor 11 as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the initial value by the time counter A, i.e. the execution of the step 535, is performed at the step 534. After the start of the counting of the predetermined time period $\Delta t_1$ by the time counter A in this way, a target air-fuel ratio setting subroutine shown in FIG. 6 for setting a target air-fuel ratio is executed through steps generally indicated at 536.

Figure 6:
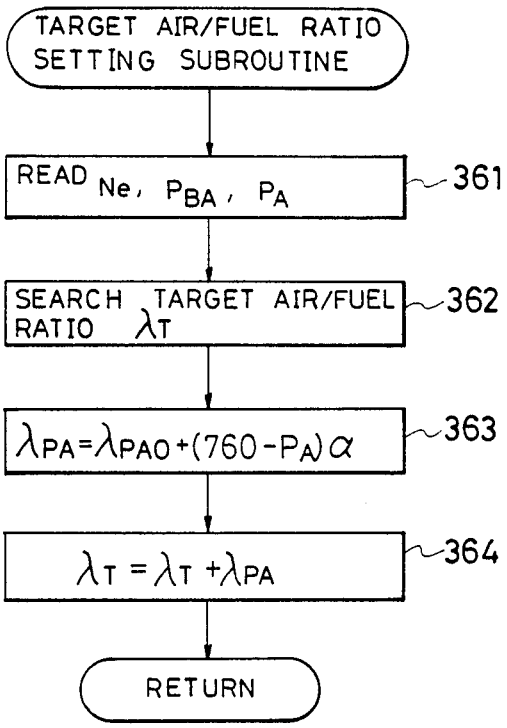
Figure 7:
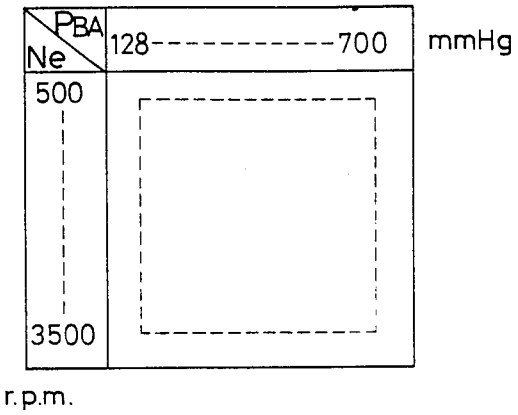
FIG. 7 is a diagram showing a data map which is previously stored in a ROM 30 of the control circuit 20.

In the target air-fuel ratio setting subroutine, as shown in FIG. 6, current values of the engine speed $N_e$, the absolute pressure $P_{BA}$, and the atmospheric pressure $P_A$ are read at step 361. For the setting of the target air-fuel ratio, various values for the target air-fuel ratio $\lambda_T$ which is determined according to the values of the absolute pressure within the intake manifold $P_{BA}$ and the engine speed $N_e$ as in the case of the $D_{BASE}$ date map, are previously stored in the ROM 30 as an A/F data map separately from the $D_{BASE}$ data map. Therefore, the CPU 29 searches a target air-fuel ratio $\lambda_T$ corresponding to the current values of the absolute pressure $P_{BA}$ and the engine speed $N_e$ from the A/F data map. After the search of the target air-fuel ratio from the A/F data map, an atmospheric pressure correction coefficient $\lambda_{PA}$ of the target air-fuel ratio is calculated at a step 363. The atmospheric pressure correction coefficient $\lambda_{PA}$ is calculated from an equation $\lambda_{PA}=\lambda_{PAO}+(760-PA)\alpha$ where $\mu_{PAO}$ is a base value of correction coefficient, and $\alpha$ is a correction coefficient. Then the target air-fuel ratio $\lambda_T$ is added to the thus calculated atmospheric pressure correction coefficient $\lambda_{PA}$ and a result is set as a new target air-fuel ratio $\lambda_T$ at a step 364. In this way, the target air-fuel ratio is set to become large as the atmospheric prsesure becomes small.

After the target air-fuel ratio is set in this way, whether or not the air-fuel ratio of the mixture which is detected from the information of the oxygen concentration in the exhaust gas is leaner than the target air-fuel ratio $\lambda_T$ is detected at a step 537. This detection is performed such that an oxygen concentration level $LO_2$ (output signal level of the $O_2$ sensor) is compared wtih a level $L_\lambda$ corresponding to the target air-fuel ratio $\lambda_T$. If it is detected at the step 537 that the air-fuel ratio of the mixture is leaner than the target air-fuel ratio, a subtraction value $I_L$ is calculated at a step 538. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of operations of the A/F routine is read out from a memory location $a_1$ in the RAM 31. Subseqeuntly, the subtraction value $I_L$ is subtracted from the correction value $I_{OUT}$, and a result is in turn written in the memory location $a_1$ of the RAM 31 as a new correction value $I_{OUT}$, at a step 539. On the other hand, if $LO_2 \leqq Lref$ at the step 537, it means that the current air-fuel ratio of the mixture is richer than the target air-fuel ratio, and a summing value $I_R$ is calculated at a step 5310. The summing value $I_R$ is calculated by a multiplication among a constant value $K_2$ ($\neq K_1$), the engine speed $N_e$, and the absolute pressure $P_{BA}$ $(K_2 \cdot N_e \cdot P_{BA})$, and is dependent on the amount of the intake air of the engine 5. After the calculation of the summing value $I_R$, the correction value $I_{OUT}$ which is previously calculated by the execution of the A/R routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 5311. After the calculation of the correction value $I_{OUT}$ at the step 539 or the step 5311 in this way, the correction value $I_{OUT}$ and the period of base duty ratio $D_{BASE}$ set at the step 533 are added together, and a result of the addition is used as the valve open period $T_{OUT}$ at a step 5312.

Additionally, after the reset of the time counter A and the start of the counting from the initial value at the step 535, if it is detected that the predetermined time period $\Delta t_1$ has not yet passed at the step 534, the operation of the step 5312 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$ at a step 54. Subsequently, a value corresponding to the valve close period $T_{AF}$ is set in a time counter B incorporated in the CPU 29 (not shown), and down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is effected repeatedly.

Figure 8:
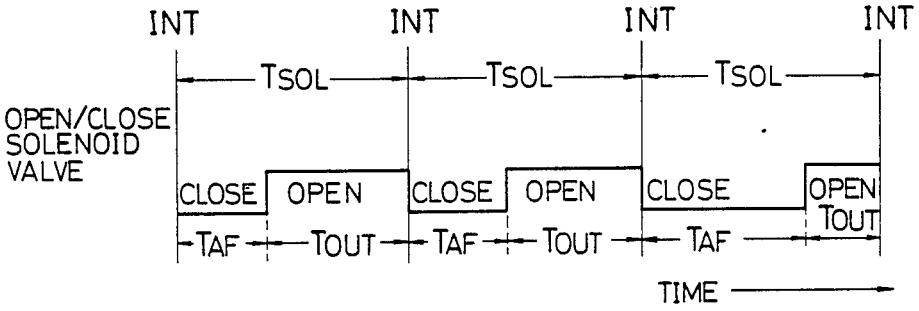
FIG. 8 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 8, to stop the supply of the air intake side secondary air to the engine 5. When the valve close time $T_{AF}$ for the open/close solenoid valve 9 within the period of one duty cycle is calculated and the valve close time $T_{AF}$ has passed after the generation of the interruption signal, the open/close solenoid valve 9 is opened to supply the air intake side secondary air to the engine through the air intake side secondary side supply passage 8. Thus, the duty ratio control of the supply of the air intake side secondary air is performed by repeatedly executing these operations. Further, the air-fuel ratio of the mixture to be supplied to the engine 5 is controlled to the target air fuel ratio by a duty ratio control of the supply of the air intake side secondary air. Through these operations, the accuracy of the air-fuel ratio control and the response characteristic of the control system with respect to the air intake side secondary air supply command are improved. Moreover, the delay of response of the control operation due to the change in the operational state of the engine are compensated for by setting the period of base duty ratio $D_{BASE}$ in accordance with the operating condition of the engine.

In the above explained embodiment, the air-fuel ratio control system was in the form of an air intake side secondary air supply system. However, it is be noted that the application of the present invention is not limited to this, and for instance, the present invention is applicable to a system in which the amount of fuel to be supplied to the engine is controlled.

In summary, in the air-fuel ratio control system according to the present invention, the target air-fuel ratio determined according to predetermined engine parameters is corrected in response to a magnitude of the atmospheric pressure. Therefore, the reduction of the density of the intake air in an area of high altitude is compensated for by correcting the target air-fuel ratio to the lean side as the atmospheric pressure decreases. Thus, the redution of the engine output power in an area of high altitude is prevented.

Figure 9:
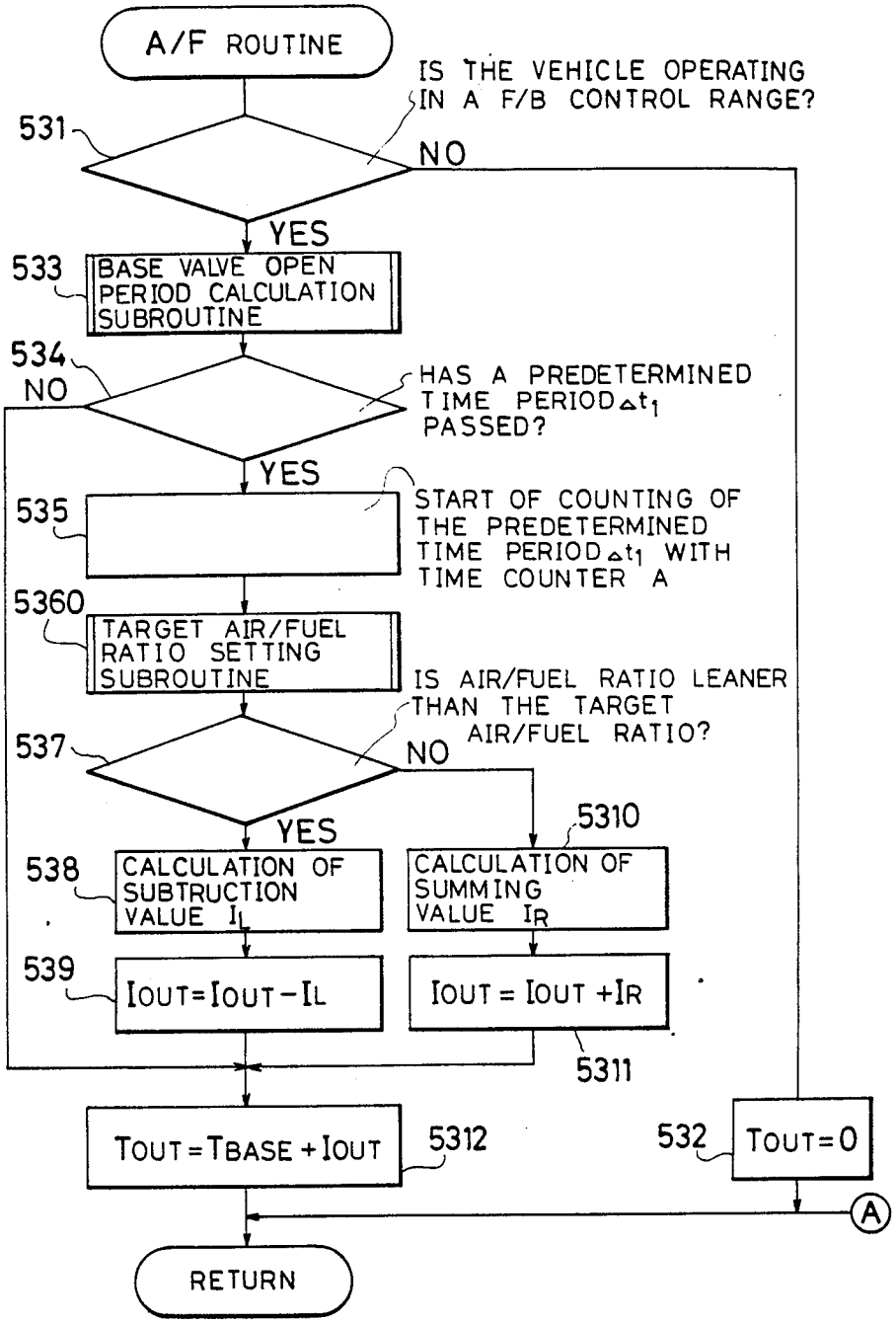
Figure 10:
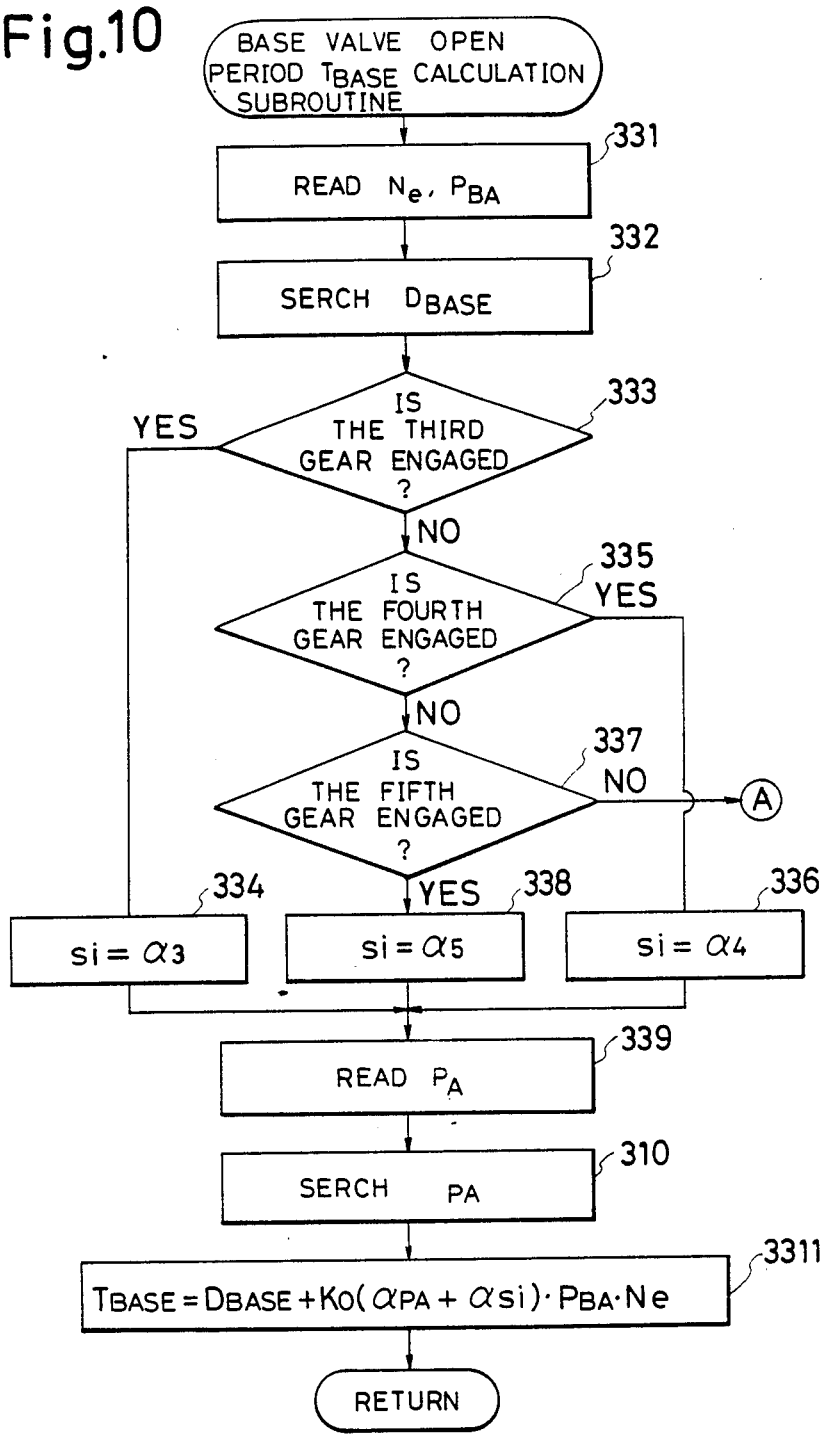
Figure 11:
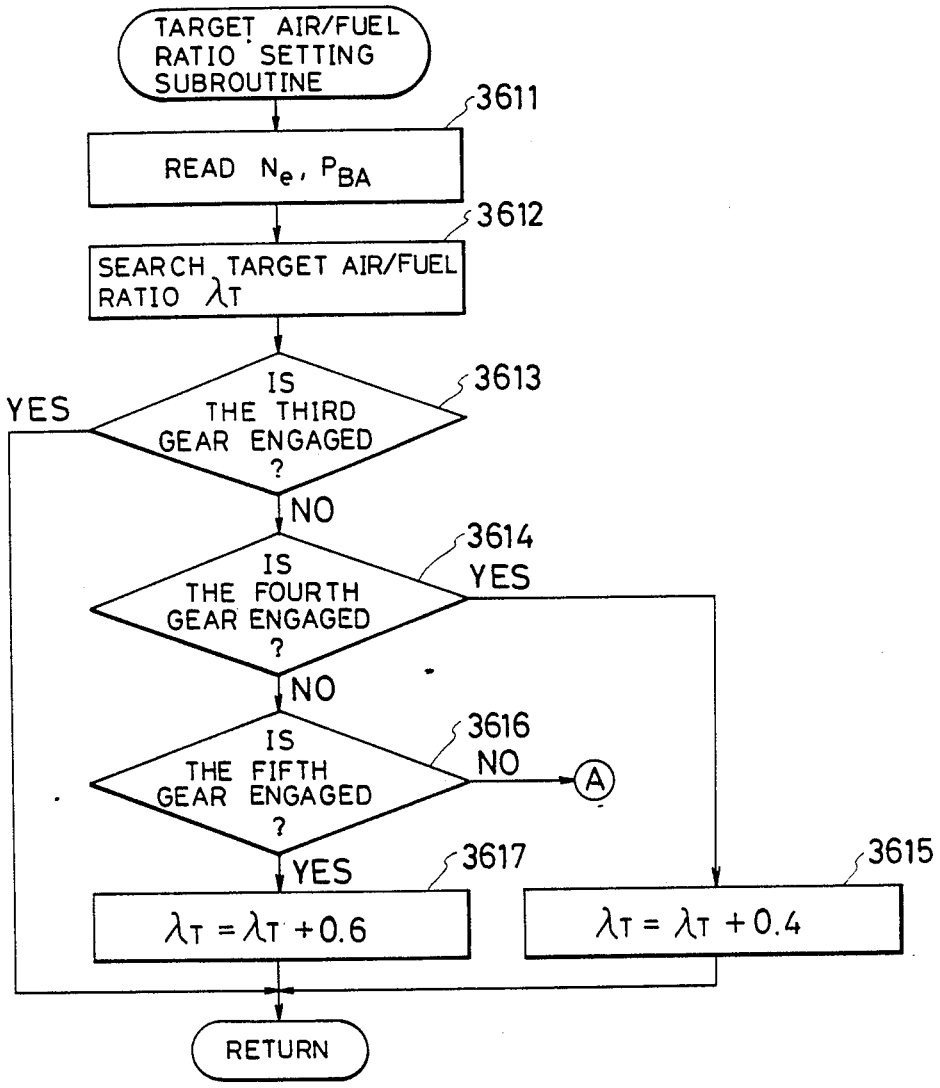

Referring to FIGS. 9 through 11, the second embodiment of the air intake side secondary air supply system according to the present invention will be explained hereinafter.

Since the construction and the operation of the second embodiment are the same as those of the first embodiment which have been explained with reference to FIGS. 1 through 8 except the operations of the A/F routine, the explanations thereof are not repeated.

FIG. 9 shows the detail of the A/F routine of the second embodiment. In the A/F routine of this embodiment, whether or not operating states of the vehicle (including operating states of the engine) satisfy a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, when the engine cooling water temperature is low, or when the shift position of the transmission gear is in the first, second or the neutral position, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, a $T_{BASE}$ calculation routine for calculating a base valve open period $T_{BASE}$ for the opening of the open/close solenoid valve 9 within the period of one duty cycle $T_{SOL}$ is executed at a step 533.

As shown in FIG. 10, in the $T_{BASE}$ calculation routine, current values of the engine speed $N_e$ and the absolute pressure within the intake manifold $P_{BA}$ are read at a step 331. Various values for a period of base duty ratio $D_{BASE}$ which are determined according to the absolute pressure $P_{BA}$ and the engine speed $N_e$ are previously stored in the ROM 30 in the form of a $D_{BASE}$ data map as shown in FIG. 7. Therefore, the CPU 29 first reads the current values of the absolute pressure $P_{BA}$ and the engine speed $N_e$ and in turn searches a value of the period of base duty ratio $D_{BASE}$ corresponding to the read values from the $D_{BASE}$ data map in the ROM 30. After the period of base duty ratio $D_{BASE}$ has been searched, whether or not the five speed transmission of the vehicle is shifted to the third gear, in other words, whether or not the third gear is engaged, is detected at a step 333. If the third gear is engaged, a shift position correction coefficient $\alpha_{si}$ is made equal to a predetermined value $\alpha_3$ (18 μs for example) at a step 334. If the shift position is not the third gear, whether or not the fourth gear is engaged is detected at a step 335. If the fourth gear is engaged, the shift position correction coefficient $\alpha_{si}$ is made equal to a predetermined value $\alpha_4$ (38 μs for example) which is larger than the value $\alpha_3$ at a step 336. If the fourth gear is not engaged, whether or not the fifth gear is engaged is detected at a step 337. If the fifth gear is engaged, the shift position correction coefficient $\alpha_{si}$ is made equal to a predetermined value $\alpha_5$ (58 μs for example) which is larger than the value $\alpha_4$ at a step 338. If the fifth gear is not engaged, it means that the shift position is in one of the first gear, second gear, and the neutral positions. Therefore, the CPU 29 determines that the operation of the A/F routine is finished, and returns to the execution of the main routine. After the set of the shift position correction coefficient $\alpha_{si}$, a current value of the atmospheric pressure $P_A$ is read at a step 339. Then an atmospheric pressure correction coefficient $\alpha_{PA}$ which is determined according to the atmospheric pressure value $P_A$ read at the step 339 is searched from an $\alpha_{PA}$ data map at a step 310. In the ROM 30, various values for the atmospheric pressure correction coefficient $\alpha_{PA}$ determined from the atmospheric pressure $P_A$ are stored as the $\alpha_{PA}$ data map separately from the $D_{BASE}$ data map. The values for the atmospheric pressure correction coefficient $\alpha_{PA}$ are set such that it becomes large as the atmospheric pressure reduces. Then the base valve open period $T_{BASE}$ is calculated by an equation $T_{BASE}=D_{BASE}+K_0(\alpha_{PA}+\alpha_{si})\cdot P_{BA}\cdot N_e$, where $K_0$ is a constant, at a step 3311.

In addition, the detection at the step 337 can be omitted since the step 531 will detect that the condition for the feedback control is not satisfied if the shift position is in any one of the first, second and the neutral positions. In the above steps, the shift position is detected by means of the vehicle speed $V_H$ and the engine speed Ne because regions of a ratio between the vehicle speed $V_H$ and the engine speed Ne different from each other are obtained for the first to fifth gear of the transmission.

After the calculation of the base valve open period $T_{BASE}$ is this way, the operation through steps 534 and 535, i.e., the detection of the elapse of the predetermined period $\Delta t_1$, is performed in the same way as the previous embodiment. When the count of the predetermined time period $\Delta t_1$ by means of the counter A is started, a target air-fuel ratio setting subroutine which is generally indicated at 536 and depicted in FIG. 11 is performed.

In the target air-fuel ratio setting subroutine in this embodiment, current values of the engine speed $N_e$ and the absolute pressure $P_{BA}$ are read at a step 3611. Then a value of the target air-fuel ratio $\lambda_T$ is searched from the A/F data map prepared in the ROM 30 at a step 3612. In the ROM 30, the A/F data map is prepared in the same way as the previous embodiment. After the searching of the target air-fuel ratio, whether or not the third gear of the five speed transmission is engaged is detected at a step 3613. If the third gear is engaged, the searched value of the target air-fuel ratio is maintained. If the third gear is not engaged, whether or not the fourth gear is engaged is detected at a step 3614. If the fourth gear is engaged, a value of 0.4 is added to the searched target air-fuel ratio and a result of calculation is set as a new target air-fuel ratio at a step 3615. If the fourth gear is not engaged, whether or not the fifth gear is engaged is in turn detected at a step 3616. If the fifth gear is engaged, a value 0.6 is added to the searched value of the target air-fuel ratio and a result of the calculation is set as a new value of the target air-fuel ratio at a step 3617. If the fifth gear is not engaged, it means that the shift position is any one of the first, second and the neutral positions, and the CPU 29 determines that the A/F routine has completed and returns to the execution of the main routine. In the above operations, the step 3616 can be omitted as in the case of the step 337.

After the target air-fuel ratio is set in this way, the remaining steps of the A/F routine, i.e., the steps 537 through 5312 are executed in the same manner as in the previous embodiment. Further, after the execution of the A/F routine, the control of the open/close valve, i.e., the steps 54 through 57 are executed in the same manner as the previous embodiment.

In summary, the shift position correction coefficient $\alpha_{si}$ is determined to be larger for a higher gear position than that for a lower gear position. Thus, the air-fuel ratio is made leaner for the higher gear position, with the prolonged base valve open period $T_{BASE}$. In addition, the air-fuel ratio is also made leaner than the altitude of the area in which the vehicle is running becomes higher, by means of an increase in the atmospheric pressure correction coefficient $\alpha_{PA}$, which extends the base valve open period $T_{BASE}$.

It will be appreciated from the foregoing the, with the air-intake side secondary air supply system according to the present invention, the output valve open period is determined by correcting the base valve open period at least in response to the magnitude of the atmospheric pressure and the result of the detection of the air-fuel ratio by means of an output signal level of the $O_2$ sensor. The open/close valve is opened only during the output valve open period. Therefore, the air-fuel ratio of the mixture is controlled accurately toward the target air-fuel ratio under various operating coditions of the engine mounted on the vehicle by means of the correction operation by which the air-fuel ratio is shifted more to the lean side as the altitude of the area becomes higher. In this way, an improvement of the fuel consumption characteristic in an area of high altitude is realized.

What is claimed is:

1. An air-fuel ratio control system for an internal combustion engine mounted on a vehicle, comprising:

an oxygen concentration sensor disposed in the exhaust passage of said interal combustion engine and producing an output signal whose level increases and decreases generally in proportion to an oxygen concentration of the exhaust gas flowing through said exhaust passage;

atmospheric pressure detecting means for detecting the atmospheric pressure exerted on said vehicle;

target air-fuel ratio determining means for determining a target air-fuel ratio in accordance with preselected operational parameters of said engine, and for correcting the target air-fuel ratio in accordance with the detected atmospheric pressure;

comparing means for comparing the level of the output signal of said oxygen concentration sensor with said corrected target air-fuel ratio; and feedback means for controlling the air-fuel ratio of an air-fuel mixture to be supplied to said engine in response to the result of the comparison by said comparing means toward the corrected target air-fuel ratio.

2. An air-fuel ratio control system for an internal combustion engine mounted on a vehicle and having an air intake passage with a carburetor and an exhaust passage, comprising:

an intake side secondary air supply passage leading to the air intake passage on the downstream side of the carburetor;

an open/close valve disposed in said air intake side secondary air supply passage for controlling an amount of the secondary intake air being supplied to said engine;

an oxygen concentration sensor disposed in said exhaust passage and producing an output signal whose level increases and decreases generally in proportion to the oxygen concentration of the exhaust gas flowing through said exhaust passage;

atmospheric pressure detecting means for detecting the atmospheric pressure exerted on said vehicle;

air-fuel ratio control means for controlling an air-fuel ratio of an air-fuel mixture to be supplied to said engine, said control means including means for setting a base valve open period in response to preselected engine parameters of said engine every cycle period, target setting means for setting a target air-fuel ratio in accordance with preselected engine parameters of said engine, comparing means for comparing the output signal level of said oxygen concentration sensor with said target air-fuel ratio to determine whether an air-fuel ratio of mixture to be supplied to the engine is leaner or richer than said target air-fuel ratio, correcting means for correcting said base valve open period in accordance with the detected atmospheric pressure and the determination by said comparing means thereby to provide an output valve open period, and drive means for opening said open/close valve during said output valve open period within each cyclic period.

3. An air-fuel ratio control system for an internal combustion engine mounted on a vehicle and having an air intake passage, a carburetor, and an exhaust passage comprising:

an air intake side secondary air supply passage leading to said air intake passage on the downstream side of said carburetor;

valve means disposed in said air intake side secondary air supply passage for controlling an amount of the secondary intake air supply;

means for generating a signal representative of the oxygen concentration of exhaust gases flowing through said exhaust passage, said means including a substantially linear $O_2$ sensor;

atmospheric pressure detecting means for detecting the atmospheric pressure exerted on said vehicle;

air-fuel ratio control means for controlling an air-fuel ratio of an air-fuel mixture to be supplied to said engine, said air-fuel ratio control means including mean for setting a base valve opening in accordance with preselected engine parameters of said engine;

target setting means for setting a target air-fuel ratio in accordance with preselected engine parameters of said engine;

comparing means for comparing the level of said oxygen concentration signal with said target air-fuel ratio so as to determine whether an air-fuel ratio of an air-fuel mixture supplied to said engine is leaner or richer than said target air-fuel ratio;

correcting means for correcting said base valve opening in accordance with the detected atmospheric pressure and the determination by said comparing means; and drive means for driving said valve means in response to the corrected base valve opening.

4. An air-fuel ratio control system as set forth in claim 1, in which said target air-fuel ratio determining means is operative to correct the target air-fuel ratio by increasing the target air-fuel ratio as the atmospheric pressure exerted on said vehicle decreases.

5. An air-fuel ratio control system as set forth in claim 1 wherein said internal combustion engine has a carburetor and an intake manifold, and said feedback control means includes an air intake side secondary air supply passage leading to said intake manifold on the downstream side of said carburetor, an open/close valve disposed in said air intake side secondary air supply passage for controlling the amount of secondary intake air that is supplied, and valve drive control means for controlling a ratio of opening and closing of said open/close valve in response to preselected operational parameters of said engine and the result of the comparison by said comparing means.

* * * * *